United States Patent [19]

Sbordonne

[11] Patent Number: 4,907,999

[45] Date of Patent: Mar. 13, 1990

[54] DEVICE FOR HOLDING A SUBSTANTIALLY PARALLELEPIPED SHAPED PART IN POSITION

[75] Inventor: Arturo Sbordonne, Anagni, Italy

[73] Assignee: Videocolor, Montrouge, France

[21] Appl. No.: 269,705

[22] Filed: Nov. 10, 1988

[30] Foreign Application Priority Data

Nov. 13, 1987 [FR] France ..... 8715672

[51] Int. Cl.[4] ..... H01J 9/22

[52] U.S. Cl. ..... 445/66; 269/254 CS; 269/256 296; 269/908

[58] Field of Search ..... 269/908, 254 R, 254 CS, 269/218, 256, 296; 445/66, 68; 279/1 L

[56] References Cited

U.S. PATENT DOCUMENTS 1,111,878 9/1914 Carroll ..... 269/254 R
4,133,570 1/1979 Hammink et al. ..... 294/110.1
4,258,928 3/1981 Wiesler ..... 279/1 L
4,480,181 10/1984 Fisher ..... 269/256 X

FOREIGN PATENT DOCUMENTS 2500213 8/1982 France .
2536907 6/1984 France .

*Primary Examiner*—Kenneth J. Ramsey
*Attorney, Agent, or Firm*—Oblon, Spivak, McClelland, Maier & Neustadt

[57] ABSTRACT

Disclosed is a device for holding a substantially parallelepiped-shaped part in position. This device has, fixed on a base, a supporting device on which the part rests and two supporting elements which clamp the part on two opposite sides. The two supporting elements are fixed to a deformable, quadrillateral element so that there is a continuously variable distance between the two supporting elements.

6 Claims, 3 Drawing Sheets

DEVICE FOR HOLDING A SUBSTANTIALLY PARALLELEPIPED SHAPED PART IN POSITION

BACKGROUND OF THE INVENTION

1. Field of the Invention

The present invention concerns a device for holding a substantially parallelepiped part in position, and more especially a device for holding cathode tube screens in position.

For cathode tubes, devices of this type for holding the screens in position or for clamping the screens can be used at any point in the assembly line. However, they are used especially in rooms where luminous substances are deposited on the screen.

2. Description of the Prior Art

As shown in FIG. 1, the devices currently used to hold cathode tube screens in position consist essentially of a base 1 which may be, for example, a rectangular frame with its two big sides each having two fixed supporting points 2 designed to receive the front surface of the screen. Furthermore, on one of the small sides of the base 1, a first supporting element is mounted in a fixed way. This first supporting element consists of a vertical column 3 to an arm 4 is fixed perpendicularly. This arm 4 carries, at each end, a sleeve 5. The sleeve 5 is preferably made of an elastic material such as rubber. A second supporting element, in rotatable on the axis A, is mounted on the other small side of the base 1. This second supporting element consists of a vertical column 3' at the upper end of which an arm 4' is fixed perpendicularly. This arm 4' too has a sleeve 5', made of an elastic material, at its two ends. With this device, the front face of the screen E is placed so as to be supported on the four supporting points 2. Then this screen is moved in translation so that one of the sides of the skirt J of the screen is supported against the two sleeves 5 of the fixed supporting element. During this time, the movable supporting element 3' is kept at a distance to enable the screen to be positioned. Then, the movable supporting element is brought to rest against the other side of the skirt by releasing a spring 6 and a pushbutton 6', thus causing the movable supporting element to be clamped against the screen. Furthermore, the base 1 has a hub designed to receive a vertical shaft 12. This vertical shaft is fixed to an machining head. As shown in FIG. 1, this machining head essentially has a frame 8 to which a perpendicular bracket 9 is fixed. At the end of the bracket, there is fixed a hollow sleeve 11, pivoting on the axis 10. The shaft 12 is inserted in the sleeve 11. It goes through hub 7 and is fixed in position by means of a system with screws. This system enables the setting of the working height of the screen. The term "working height" implies the distance between a pivoting point 10 and a plane P determining the soldering edge of the screen to the cone. This device can work accurately only with screens which all have the same dimensions. The use of a fixed supporting element and a moving supporting element necessitates screens of the same length to obtain precise centering of the screen. If centering of this type is not obtained, large-scale vibrations are observed on the machining head, and this results in a great many manufacturing rejects. Furthermore, during the centering process, there is always a slight slipping of the surface of the screen on the supporting points thus causing grooves on the glass slab. Furthermore, when there are screens of different heights, the working height is not maintained to and certain operations such as soldering or other operations may not be achieved. This type of device therefore limits the flexibility of the assembly line.

SUMMARY OF THE INVENTION

An object of the present invention is to overcome the above-mentioned drawbacks by proposing a new device to hold substantially parallelepiped-shaped parts, such as screens for cathode tubes, in position.

Consequently, an object of the invention is to provide a device for holding a substantially parallelepiped-shaped part in position, said device being of the type comprising the following elements fixed to a base: a supporting device on which the part rests and at least two supporting elements that clamp the part on two opposite sides, wherein the two supporting elements are fixed by a deformable quadrilateral element so that there is a continuously variable distance between the two supporting elements.

According to a preferred embodiment, the deformable quadrilateral element consists of two arms of the same length hinged at their midpoints on the base, and by two side members respectively hinged on the opposite ends of the two arms, a supporting element being fixed to one end of a side member while the other supporting element is fixed to the other end of the other side member.

According to another characteristic of the invention, the device further includes a means for exerting a force on the two supporting elements in a position where they are at a minimum distance from each other. This means for exerting force on the two supporting elements, in their position where they are at a minimum distance from each other, consists of at least one spring fixed between the two supporting elements. Preferably, the means for exerting force on the two supporting elements, in their position where they are at a minimum distance from each other, consists of two springs each fixed by a supporting element and the end of the side member of the other supporting element. With this device, precise centering of the part is obtained regardless of its dimensions.

According to another characteristic of the present invention, the supporting device comprises means for the pre-positioning of the part, said means being solidly joined to the base, and at least three supporting points fixed to the base so as to be capable of being shifted vertically.

According to a preferred embodiment, each supporting point is designed to be at the end of a lever hinged on the base, the position of said lever being fixed by a stop which is solidly joined with one of the side members. This arrangement of supporting points enables the adjustment of the working height according to the height of the parallelepiped shaped part.

BRIEF DESCRIPTION OF THE DRAWINGS

Other features and advantages of the present invention will emerge from the following description of a preferred embodiment made with reference to the appended drawings, of which.

DESCRIPTION OF THE PREFERRED EMBODIMENT

Figure 1:
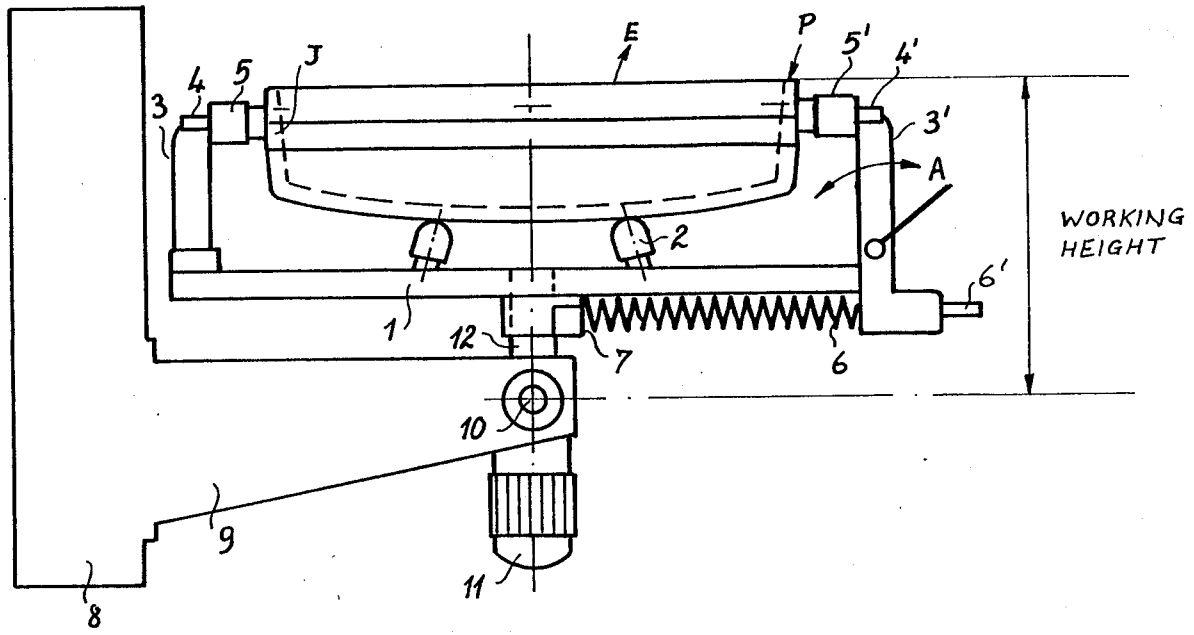
FIG. 1, already described, is a schematic view in elevation of a device according to the prior art.
Figure 2:
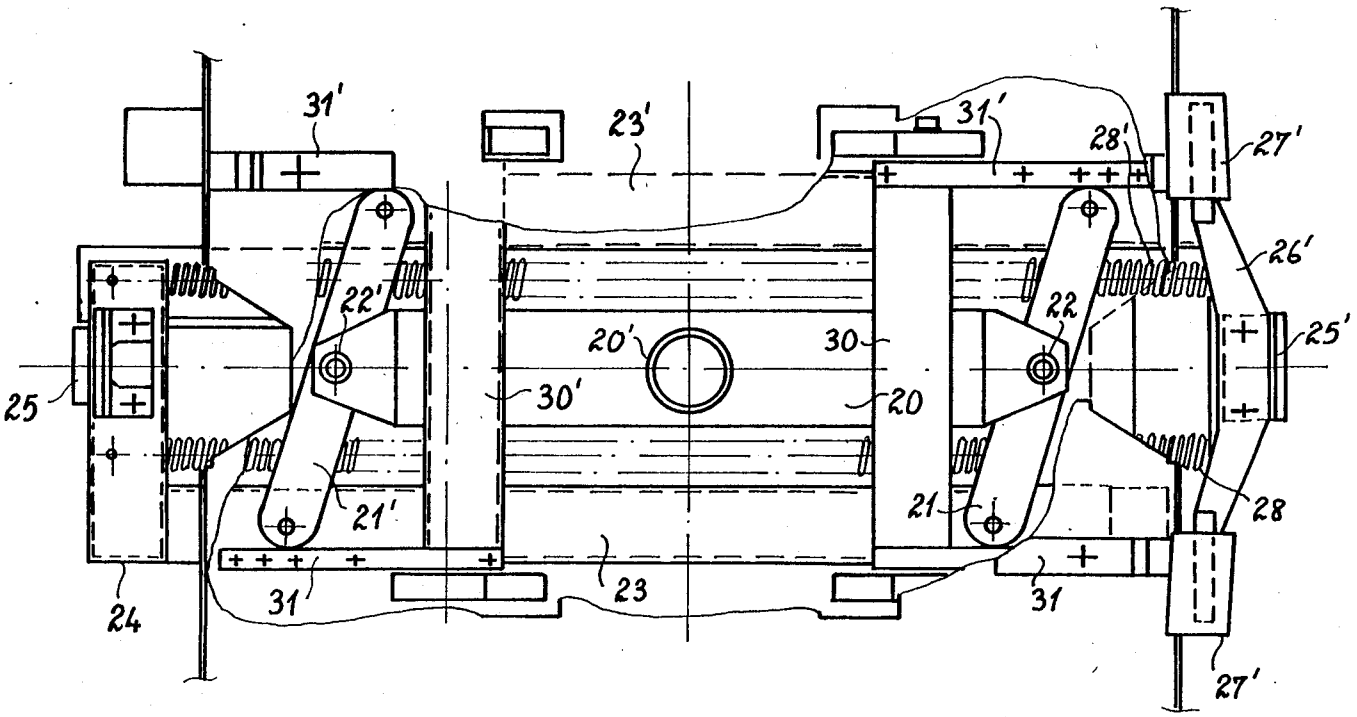
FIG. 2 is a partially exploded plane view, from the top, of a device for holding a part in position according to the present invention and, FIG. 3 shows schematic view, in elevation, of the device of FIG. 2.
Figure 3:
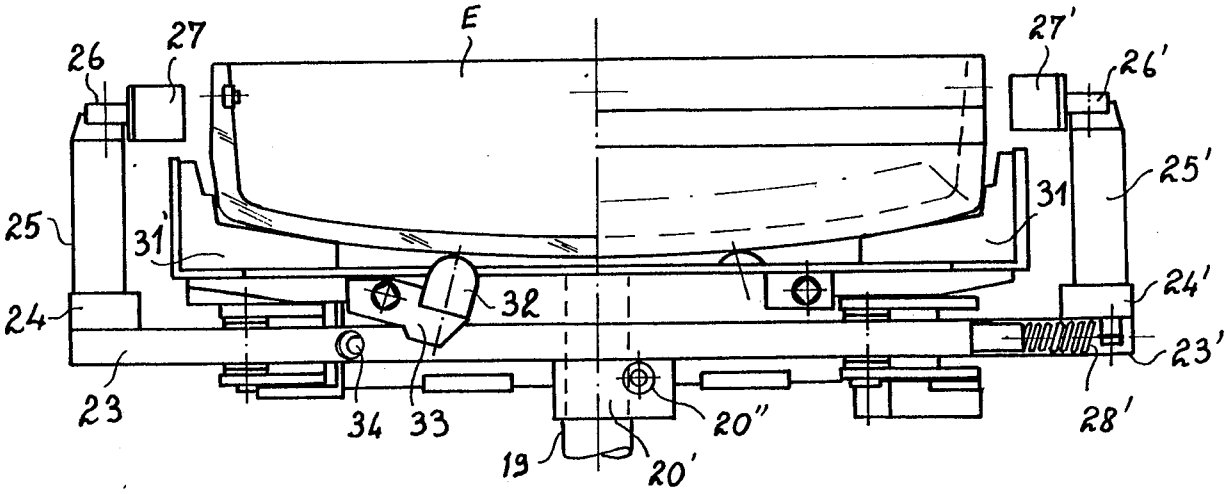

As shown in FIGS. 2 and 3, the device according to the present invention for holding a part in position essentially has a base 20. This base has a hub 20' enabling the passage of the shaft of the machining head, and a device 20" enabling the shaft to be clamped inside the hub. According to the present invention, two arms 21 and 21', of the same length, are hinged at their midpoints, on each end of the socket 20 as represented by the points 22 and 22' in FIG. 2. Furthermore, two side members, 23 and 23', are respectively hinged on the opposite ends of the arms 21 and 21' so as to form a deformable, quadrilateral element. At the end of the side member 23, which is on the arm 21' side, there is fixed a perpendicular arm 24. A vertical column 25 is screwed into this arm 24. At its midpoint, this vertical column 25 supports a horizontal arm 26. At an end of each arm 26, 26' is mounted a sleeve 27 made of an elastic material such as rubber. These elements 24, 25, 26 and 27 form a first supporting element. Similarly, a second supporting element, consisting of arms 24', the column 25', the arm 26' and two sleeves 27', is mounted at the end of the side member 23' which is on the arm 21 side. Furthermore, two springs 28 and 28' are respectively provided between the arm 24 and the opposite end of the side member 23' or between the arm 24' and the opposite end of the side member 23. These two springs make it possible to hold the two supporting elements in their minimum position where they are at a minimum distance from each other, as shall be explained further below.

With the device described above, the screen E is positioned as follows. A thrust greater than the force exerted by the springs 28 and 28' is exerted on one of the side members. This thrust exerted on one of the side members causes the other side member to move in the opposite direction, thus making the supporting elements move away from each other. It then becomes possible to introduce the screen E between these two supporting elements. When there is no longer any thrust exerted on one of the beams, the pull-back force of the springs 28 and 28' brings the two supporting elements into contact with the skirt of the screen E. Since the side members and the two arms 21 and 21' form a hinged quadrilateral element, the two supporting elements are shifted symmetrically and by the same distance with respect to the axis of the device corresponding to the axis of the machining head. Consequently, if the screen E is precisely centered in the device, there is no risk of slipping between the supporting points and the glass. Furthermore, a device of this type can be suited for any screen dimensions, without any problem of centering arising out of this symmetrical shift.

The device, according to the invention, for holding a part in position further has a supporting device on which the part rests before it is clamped between the two supporting elements. This supporting device has means for the pre-positioning of the part, said means being solidly joined to the base. As shown in FIGS. 2 and 3, this pre-positioning means consists of two cross-members 30 and 30' fixed to the base 20. At each end of the cross-members, there is fixed a supporting plate 31, 31'. The four supporting plates 31, 31' are parallel to the side members 23 and 23'. Furthermore, to receive the screen E accurately, the upper surface of the supporting plates has recesses adapted to the front surface of the screen. Furthermore, in accordance with the present invention, the device for holding the parts in position has four supporting points 32. These supporting points are each fixed to the end of a lever 33, the other end of which is mounted so that it pivots on the base 20. The four supporting points are positioned on the base in such a way that two supporting points are parallel to the side members 23 and two other supporting points are parallel to the side members 23'. Furthermore, each side member has two elements 34 forming a stop. The elements forming a stop are positioned on the side members in such a way that, in the clamped position, the lower surface of each lever 33 comes to a stop against one of the elements 34. Consequently, the height of the supporting points 32 will depend on the distance between the two side members. By accurately cutting the profile of the lower surface of the levers 33, it is thus possible to set the height of the supporting points so as to obtain the same working height regardless of the dimensions of the screen E used.

The present invention has been described with reference to a screen for cathode tubes. It is clear to those skilled in the art that the device of the present invention can also be used to clamp any substantially parallelepiped-shaped parts.

What is claimed is:

1. A device for holding a substantially parallelpiped-shaped part in position, comprising:

a base;

a support device fixed to said base and on which said part rests, said supporting device including means for pre-positioning the part, solidly joined to the base, and at least three supporting points fixed to the base so as to be vertically movable and at least two supporting elements for clamping the part on two opposite sides, said two supporting elements being fixed by a deformable quadrilateral element so that there is a continuously variable distance between said two supporting elements.

2. A device according to claim 1, wherein the deformable, quadrilateral element is formed by two arms of the same length, hinged at their midpoint on the base, and by two side members, respectively hinged on the opposite ends of the two arms, a supporting element being fixed to one end of a side member while the other supporting element is fixed to the other end of the other side member.

3. A device according to any of the claim 1, further comprising a means exerting force on the two supporting elements in the position where they are at a minimum distance from each other.

4. A device according to claim 3, wherein the means exerting force on the two supporting elements in the position where they are at the minimum distance from each other consists of at least one spring fixed between the two supporting elements.

5. A device according to claim 3, wherein the means exerting force on the two supporting elements in their position where they are at a minimum distance from each other is constituted by two springs, each fixed between a supporting element and the end of the side member of the other supporting element.

6. A device according to claim 1, wherein each supporting point is provided at the end of a lever hinged on the base, the position of said lever being fixed by a stop which is solidly joined to one of the side members.

* * * * *